United States Patent [19]

Butler et al.

[11] 4,434,927

[45] Mar. 6, 1984

[54] PENETRATOR INTERFACE ADAPTER CONCEPT

[75] Inventors: John R. Butler; Gerald D. Shock, both of White Plains; Norman J. Saunders, Nanjemoy, all of Md.

[73] Assignee: The United States of America as represented by the Secretary of the Navy, Washington, D.C.

[21] Appl. No.: 276,856

[22] Filed: Jun. 24, 1981

[51] Int. Cl.[3] ..... B21J 15/18

[52] U.S. Cl. ..... 227/9; 411/441

[58] Field of Search ..... 227/9, 10, 11; 411/440, 411/441

[56] References Cited

U.S. PATENT DOCUMENTS

| | | | |
|---|---|---|---|
| 3,377,903 | 4/1968 | Korte | 411/441 |
| 3,998,372 | 12/1976 | Leonardo et al. | 227/9 |
| 4,201,325 | 5/1980 | Jochum | 227/9 |

*Primary Examiner*—Mark Rosenbaum
*Assistant Examiner*—Timothy V. Eley
*Attorney, Agent, or Firm*—R. F. Beers; K. E. Walden; J. C. LaPrade

[57] ABSTRACT

A penetrator interface adapter comprising a generally cylindrical fluted recoilless nozzle adapter with means for positioning a penetrator with holder and an energy absorbing collar adjacent the target container so that the penetrator projects into the target or into the container to a predetermined point during each shot.

5 Claims, 3 Drawing Figures

PENETRATOR INTERFACE ADAPTER CONCEPT

BACKGROUND OF THE INVENTION

The invention relates to a fluted nozzle adapter that can be adapted to a conventional stud gun or other precussion tool for the purpose of aligning and positioning a penetrator needle in the gun combined with a shock absorber for the penetrator needle slug and an energy absorber for the penetrator needle.

It has become common in construction work and in sampling work to use powder actuated tools for driving fasteners and penetrators into a work piece or container or the like.

It has been common to shoot the penetrator or stud in free flight in the direction of the target, work piece or container to be sampled. Such a method required the varying of the levels of energy input into the penetrator or stud to match the penetration energy required to penetrate the target material. Information as to energy levels as well as the thickness of target materials, the hardness of target materials is not likely to be known to operators in the field. This is particularly true because the target material may vary widely in thickness, hardness and other characteristics.

In actual practice many problems may be encountered including overpenetration, under penetration, needle or stud fracture, target deformation and improper seal of the opening in the penetrator needle.

SUMMARY OF THE INVENTION

In view of the foregoing it is the main object of this invention to provide an adapter that ofters precise control of the direction and penetration of a sampling needle or other projectile shot from a convention stud gun.

Another object of the invention is to provide an adapter assembly for a stud gun or other powder driven guns wherein the projectile or penetrator from the stud gun penetrates a target to a precise depth without any determination of target thickness, hardness or other variable.

An additional object of the invention is to provide a device for sampling toxic and dangerous chemical wherein the penetrator extends into the container to a predetermined depth without trial and error attempts.

It is one other important objective to provide an apparatus that supports the extension of the penetrator along the column and provides control over the penetration depth.

It is one further object of the invention to provide an adapter assembly with a penetrator that eliminates overpenetration and underpenetration.

BRIEF DESCRIPTION OF THE DRAWINGS

The foregoing features and other details of the invention will now be more particularly described in connection with an illustrative embodiment and with reference to the accompanying drawings in which.

DESCRIPTION OF THE PREFERRED EMBODIMENT

Figure 1:
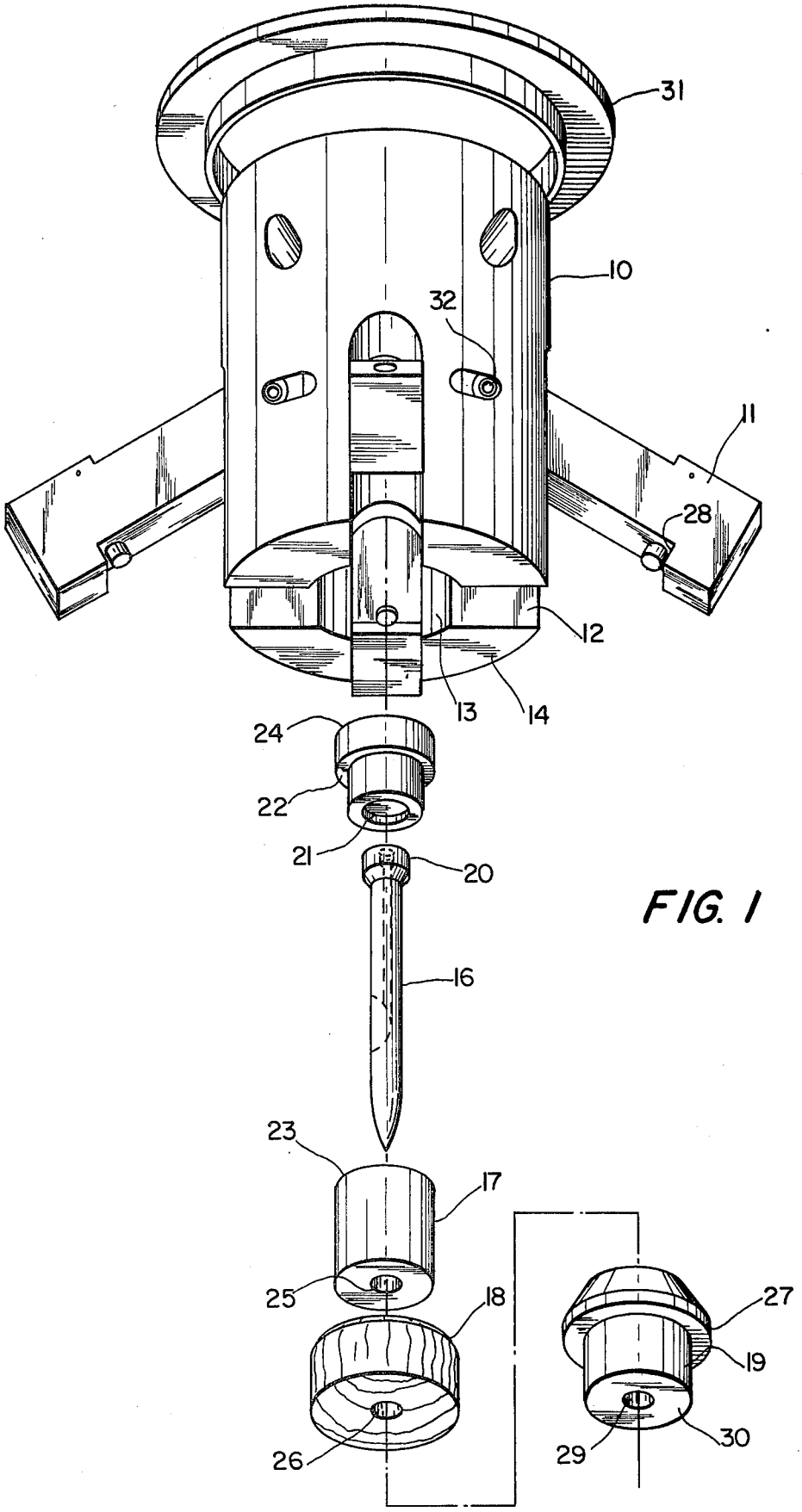
FIG. 1 is a perspective view of the adapter with the assembly of parts illustrated in sequential order.

In FIG. 1 the cylindrical outer wall 10 of the adapter is fitted with a number of pivoted retaining arms 11. The pivoted arms 11 swing forward to fit, in shooting position into slots 12. The slots 12 surround the cylindrical bore 13 that extends throughout the length of the adapter from the forward end 14 through the rearward end 15 that may be screwed or clamped to the forward end of the stud gun or other powder actuated tool. In FIG. 1 the central bore 13 is packed prior to shooting with, in order, the piston 15, the penetrator needle 16, a penetrator carrier guide means 17, the first shock absorber 18 that strips the carrier from the penetrator and the shock absorber or energy arrestor 19 that is after shooting fastened to the work piece or target by the penetrator.

In FIG. 1, the assembly is first put into the bore 13 by placing the expended base 20 of the penetrator 16 into a slot 21 in the forward face of the piston 15.

A shoulder 22 is provided near the midsection of the piston. In the assembled position the base 23 of the carrier or guide 17 rests on and is supported by shoulder 22. The piston head or face 24 is actuated by the gases developed by fixing the gun and is the means by which the hollow penetrator needle, stud or other projectile 16 is driven into the work piece, container or target.

In the assembly the carrier 17 is placed over and around the penetrator 16 by the opening 25 being fitted around the outer shaft of the penetrator 16.

The subassemblly of the piston 15, penetrative 16 and the carrier 17 are then placed into the bore 13 of the adapter 10. The outer diameter of the carrier 17, that is usually made of plastic soft metal or other equivalent material, should fit snugly within the bore 13 of the adapter. The first shock absorber 18 that also serves the function of stripping off the slug, carrier or guide element 17 is usually made of wood, soft plastic or other soft energy absorbing frangible material.

Shock absorber 18 has a cylindrical opening throughout its thickness that it varies from about 1/100 to ⅛ of an inch smaller than the diameter of the penetrator 16.

The shock absorber 19, that is usually made of a metal of hardness similar to penetrator 16 has a shoulder 27 around its entire circumference that is in shooting position engaged by the clamping extention 28 on the inner face of each pivoted arm. An opening 29 is provided through the entire thickness of the shock absorber 19. This opening is initially equal to or smaller than the diameter of the penetrator 16.

After the assembly is positioned in the adapter 10 the pivoted arms 11 with extension 28 fit over the shoulder 27 so as to secure the assembly device in position.

Figure 2:
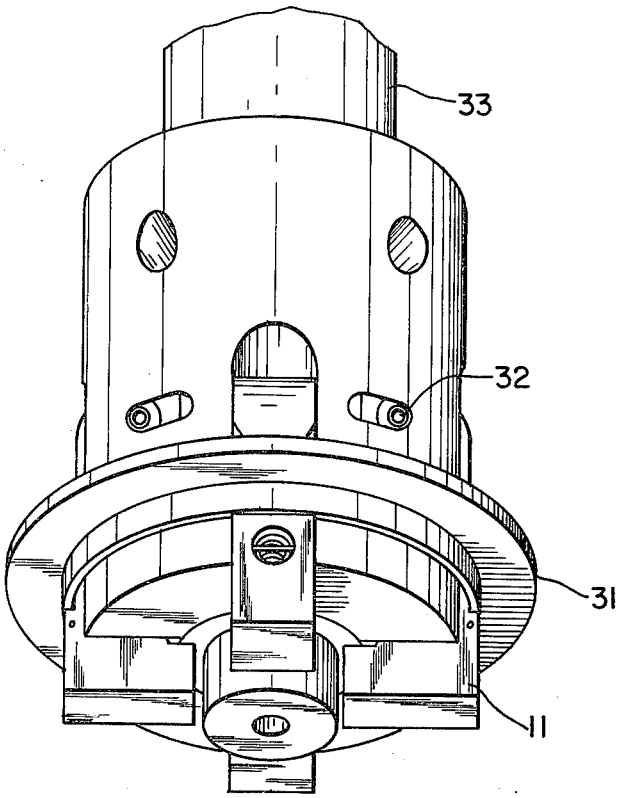
FIG. 2 is a side elevation of the adapter with parts assembled in a ready to shoot position.

Other multiple pivoted means may be used and are functionally equivalent to the multiple pivoted arms shown in FIGS. 1 and 2.

After shooting the forward face 30 of shock absorber 19 is held tightly against the by the penetrator 16.

A retaining ring 31 may be used to hold the pivoted arms 11 in position during the shooting of the penetrator.

FIG. 2 shows the assembled adapter mounted on gun 33, with openings 32 in the side wall of the adapter that communicates with the firing chamber and allow gases to escape after the penetrator has engaged the target or work piece.

Figure 3:
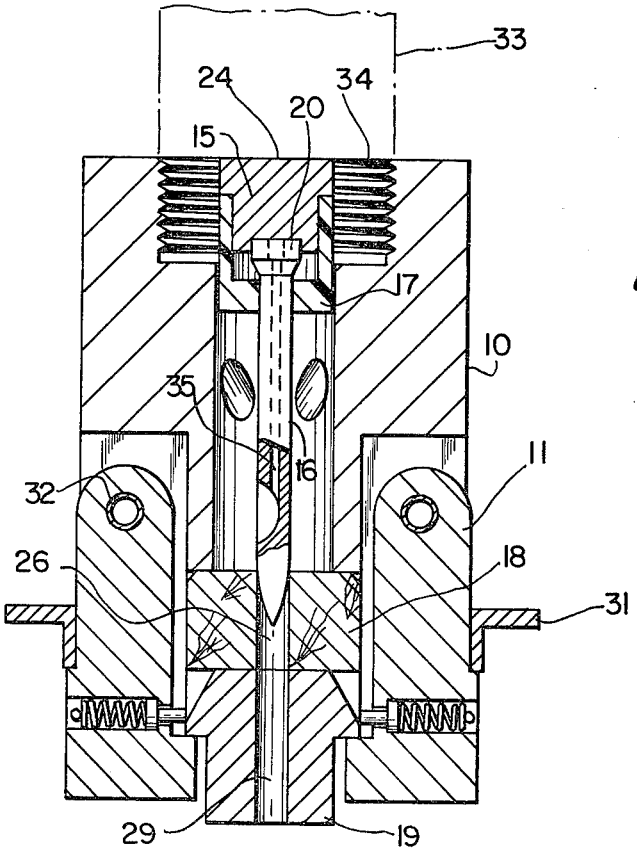
FIG. 3 is a cross section of the assembly shown in 2.

In FIG. 3, in cross section screw threads 34 are shown as the means of fastening the adapter 10 to the gun 33. The penetrator 16 is shown in FIG. 3 as a hollow member with an opening 35 running the entire length thereof.

Pivot post 32 are shown in FIG. 3 as the means of pivoting arms 11 into position.

It desirable that the second shock absorber be made of a metal that is of a hardness essentially equal to the hardness of the penetrator.

Obviously, numberous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. An assembly for use with a conventional percussion gun for guiding a driven hollow sampling penetrating needle to drive the needle a predetermined distance through the wall of a container to allow a sample to be extracted from the container comprising:

(1) a housing including a chamber adapted to be connected and firmly attached to the gun;

(2) guide carrier means to center the needle in the housing and (3) shock absorber means adapted to be positioned at the forward end of the said housing, having an opening therethrough, and where the opening is aligned with the said needle and said opening is smaller than the diameter of the needle so that the outer wall of the needle engages the opening in the shock absorber so that the shock absorber determines the depth of penetration of the needle into the container, where the housing is fitted with multiple pivoted means for clamping that functions to secure the shock absorber means to the housing and is adapted to hold the shock absorber means in position against the target piece during the shooting operation.

2. The assembly of claim 1 where the multiple pivoted means for clamping comprises a plurality of spring biased arms.

3. The assembly of claim 1 where the shock absorber means comprises one shock absorber that is fitted with a shoulder that is designed to accommodate the multiple pivoted means for clamping.

4. The assembly of claim 1 where the shock absorber means consists of a first shock absorber and a second shock absorber that are adjacent to each other.

5. The assembly of claim 4 where the multiple pivoted means for clamping fits over the shoulder of the second shock absorber and retains the second shock absorber against the target piece during the shooting operation.

* * * * *